United States Patent [19]

Mullin, Jr.

[11] Patent Number: 4,979,869

[45] Date of Patent: Dec. 25, 1990

[54] METHOD FOR STORING BOATS IN A STORAGE BUILDING

[75] Inventor: Edmund P. Mullin, Jr., Lake Forest, Ill. 60045

[73] Assignee: Outboard Marine Corporation, Waukegan, Ill.

[21] Appl. No.: 345,249

[22] Filed: May 1, 1989

Related U.S. Application Data

[62] Division of Ser. No. 145,721, Oct. 6, 1987, Pat. No. 4,850,160.

[51] Int. Cl.[5] ..... B63B 35/44; B65G 1/06

[52] U.S. Cl. ..... 414/786; 414/263; 414/283

[58] Field of Search ..... 414/786, 253, 261, 263, 414/283; 114/263, 264

[56] References Cited

U.S. PATENT DOCUMENTS

| | | | |
|---|---|---|---|
| D. 227,663 | 3/1880 | Thompson . | |
| D. 234,131 | 8/1880 | Klier . | |
| 2,193,714 | 3/1940 | Covey . | |
| 2,282,756 | 5/1942 | Curran . | |
| 3,189,198 | 6/1965 | Filak | 414/283 |
| 3,385,458 | 5/1968 | Gresham | 414/283 |
| 3,395,815 | 8/1968 | Johnson | 414/263 X |
| 3,439,815 | 4/1969 | Wagner et al. . | |
| 3,451,261 | 6/1969 | Olsen . | |
| 3,513,992 | 5/1970 | Handler . | |
| 3,543,455 | 12/1970 | Walsh . | |
| 3,756,419 | 9/1973 | Dean . | |
| 3,815,298 | 6/1974 | Pope . | |
| 4,015,381 | 4/1977 | Schmidt . | |
| 4,078,354 | 3/1978 | Crowley . | |
| 4,100,654 | 7/1978 | Sheng . | |
| 4,142,637 | 3/1979 | Kraiss . | |
| 4,190,013 | 2/1980 | Otis et al. | 414/253 X |
| 4,640,214 | 2/1987 | Bruns | 414/263 X |
| 4,797,055 | 1/1989 | Tworoger et al. | 414/283 |

*Primary Examiner*—Robert J. Spar
*Assistant Examiner*—Robert S. Katz
*Attorney, Agent, or Firm*—Michael, Best and Friedrich

[57] ABSTRACT

Disclosed herein is a method of transporting boats into a dry boat storage building having a continuous outer wall, a doorway opening through the continuous outer wall, and a substantially annular boat storage rack within the boundary formed by the continuous outer wall and having a first plurality of boat storage cells arranged in a first arc centered about the doorway and extending through substantially 90° of arc on each side of the doorway and having a second plurality of boat storage cells arranged in a second arc opposite the doorway and extending through substantially 180° of arc between the ends of the first arc, which method comprises the step of inserting a boat bow-first into a selected one of the first plurality of boat storage cells by first transporting the boat stern-first into the building through the doorway and then inserting the boat bow-first toward and into the selected one of the boat storage cells of the first plurality while rotating the boat right or left through no more than 120° of arc, and which method further comprises the step of inserting a boat bow-first into a selected one of the second plurality of boat storage cells by transporting the boat bow-first through the doorway and then inserting the boat bow-first into the selected boat storage cell of the second plurality while rotating the boat right or left through no more than 120° of arc after entering the dry boat storage building through the doorway.

2 Claims, 2 Drawing Sheets

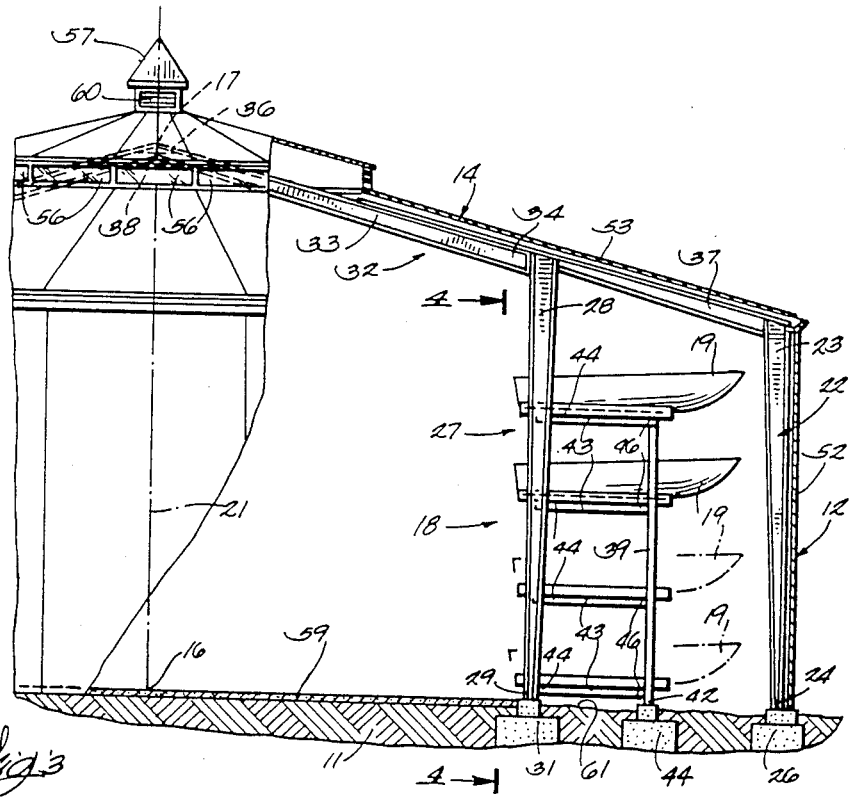
Fig. 3
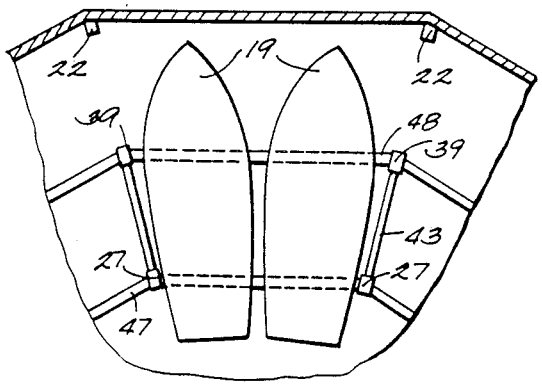
Fig. 5
Fig. 4
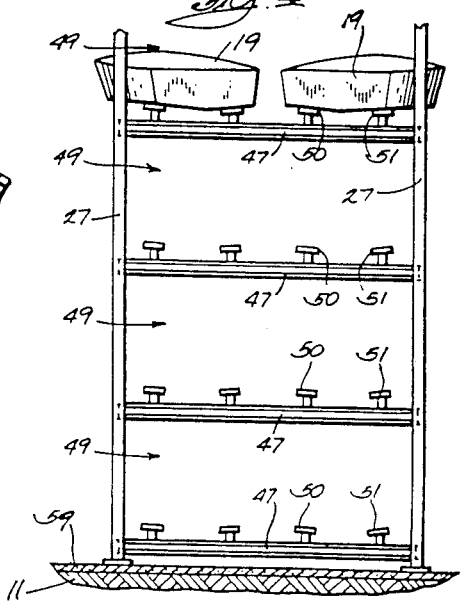

METHOD FOR STORING BOATS IN A STORAGE BUILDING

RELATED APPLICATIONS

This application is a division of application Ser. No. 105,721, filed Oct. 6, 1987, now U.S. Pat. No. 4,850,160.

BACKGROUND OF THE INVENTION

This invention relates generally to dry boat storage buildings and particularly to circular storage buildings.

During prolonged periods of disuse, pleasure-craft, such as power boats ranging in length from sixteen to twenty-six feet, have traditionally been dry stored in rectangularly shaped buildings of sheet metal construction. Though popular, such structures are not without drawbacks.

To provide access to each of the boats stored in a rectangular dry storage structure, an open space or corridor of substantial width and extending the length of the structure, must be provided. Because such a space or corridor is not utilized for actual boat storage, a considerable portion of the volume within a rectangular dry storage building is, to a large extent, wasted. Such waste increases the overall size of a dry storage facility having a given boat storage capacity and can result in increased construction costs on a per boat basis. Furthermore, because local building codes often require that rectangular dry storage facilities be provided with one or more appropriately placed fire doors, considerable expense can be incurred in complying with such requirements without contributing to the overall storage capacity of the facility. Finally, because of the various constraints that can be imposed by a building site itself, rectangular dry storage buildings do not always provide for maximum effective utilization of the space available at a particular building site.

Attention is directed to the following U.S. Pat. Nos.:

| | | |
|---|---|---|
| 4,100,654 | Sheng | July 18, 1978 |
| 4,078,354 | Crowley | Mar. 14, 1978 |
| 4,015,381 | Schmidt | Apr. 5, 1977 |
| 3,815,298 | Pope | June 11, 1974 |
| 3,513,992 | Handlér | May 26, 1970 |
| 3,451,261 | Olsen | June 24, 1969 |
| 3,439,815 | Wagner, et al | Apr. 22, 1969 |
| 2,193,714 | Covey | Mar. 12, 1940 |
| 1,614,905 | Tunison | Jan. 18, 1975 |
| Des. 234,132 | Varian | Jan. 21, 1975 |
| Des. 227,663 | Garufo, et al. | July 10, 1973 |

SUMMARY OF THE INVENTION

The invention is directed to a dry boat storage building comprising a floor surface having a center, a plurality of substantially vertical outer support columns disposed circumferentially around the center in spaced parallel relationship to one another and having upper and lower ends, a substantially annular boat storage rack disposed circumferentially around the center between the center and the vertical outer support columns, a plurality of elongate rafters respectively extending from a point spaced substantially vertically above the center to the upper ends of the vertical support columns and connected to the boat storage rack between the point and the upper end, a plurality of roof panels disposed over the rafters to form a continuous roof over the floor surface, and a plurality of wall panels disposed around the vertical support columns to form a substantially continuous wall around the boat storage rack.

The invention is also directed to a dry boat storage building comprising a floor surface having a center, a plurality of spaced outer vertical support columns disposed circumferentially around the center and having upper and lower ends, a plurality of spaced vertical inner support columns disposed circumferentially around the center between the center and the outer vertical support columns and having upper and lower ends, a plurality of outer rafters connected between the upper ends of adjacent ones of the outer and inner vertical support columns, a plurality of inner rafters each having an outer end connected to one of the upper ends of the inner vertical support columns and having an inner end extending to a point spaced substantially vertically over the center, means for connecting the inner ends of the inner rafters to one another substantially at the point, a plurality of intermediate vertical support columns having upper and lower ends disposed circumferentially around the center and between the inner and outer vertical support columns, a plurality of substantially horizontal lateral support beams connected between adjacent ones of the intermediate and inner vertical support columns at fixed vertical intervals between the upper and lower ends of the intermediate vertical support columns, a plurality of substantially horizontal outer transverse support beams connected between adjacent ones of the intermediate vertical columns at each of the horizontal levels established by the horizontal lateral support beams, a plurality of substantially horizontal inner transverse support beams connected between adjacent ones of the inner vertical support columns at each of the horizontal levels established by the horizontal lateral support beams, a plurality of substantially vertical panels connected between adjacent ones of the outer vertical support columns so as to form a substantially continuous vertical wall around the center, and a plurality of panels connected between adjacent ones of the inner rafters and between adjacent ones of the outer rafters to form a substantially continuous roof over the floor surface.

The invention is also directed to a method of transporting boats into a dry boat storage building having a continuous outer wall, a doorway opening through the continuous outer wall, and a substantially annular boat storage rack within the boundary formed by the continuous outer wall and having a first plurality of boat storage cells arranged in a first arc centered about the doorway and extending through substantially 90° of arc on each side of the doorway and having a second plurality of boat storage cells arranged in a second arc opposite the doorway and extending through substantially 180° of arc between the ends of the first arc formed by the first plurality of boat storage cells adjacent the doorway, the method comprising the steps of inserting a boat bow-first into a selected one of the first plurality of boat storage cells by first transporting the boats stern-first into the building through the doorway and then transporting the boat bow-first toward and into the selected one of the boat storage cells of the first plurality while rotating the boat right or left through no more than 120° of arc, the method further comprising the step of inserting the boat bow-first into a selected one of the second plurality of boat storage cells by transporting the boat bow-first through the doorway and then inserting the boat bow-first into the selected boat storage cell of the second plurality while rotating the boat right or left through no more than 120° of arc after entering the dry boat storage building through the doorway.

In one embodiment, the boat storage rack includes a plurality of substantially vertical inner support columns disposed circumferentially around the center between the center and the outer support columns, each of the inner support columns having a lower end fixed to the floor surface and having an upper end fixed to one of the elongate rafters.

In one embodiment, the building includes an equal number of the inner and outer vertical support columns and the lower ends of the inner vertical support columns respectively engage the floor surface along radii extending from the center through the outer vertical support columns.

In one embodiment, the boat storage rack includes, between each of the inner and outer vertical support columns, an intermediate vertical support column having a lower end engaging the floor surface between the inner and outer vertical support columns, and the boat storage rack further comprises a plurality of substantially horizontal lateral support beams respectively extending between the intermediate vertical support columns and the inner vertical support columns.

In one embodiment, the inner vertical support columns are longer than the outer vertical support columns whereby the elongate rafters slope downwardly from the point to the upper ends of the outer vertical support columns such that the roof is downwardly pitched from the point toward the continuous wall.

In one embodiment, the fixed floor surface includes a concrete slab disposed inwardly of the boat storage rack and over the center and the floor surface further includes a substantially annular gravel surface between the concrete slab and the outer vertical support columns.

In one embodiment, the radial distance between the center and the inner support columns is between substantially 75% and substantially 200% of the radial distance between the inner support columns and the outer support columns.

In one embodiment, the radial distance between the center and the inner support columns is substantially 150% of the radial distance between the center and the inner support columns.

Various other principal features of the invention will become apparent to those skilled in the art upon review of the following detailed description, claims and drawings.

DESCRIPTION OF THE DRAWINGS

FIG. 3 is a fragmentary side elevational view, partially in section, of the dry boat storage building shown in FIGS. 1 and 2.

FIG. 4 is a cross-sectional view of the dry boat storage building shown in FIG. 3 taken along line 4-4 thereof.

FIG. 5 is an enlarged, fragmentary, top plan view, similar to FIG. 2, showing a boat storage cell within the dry boat storage building.

Figure 1:
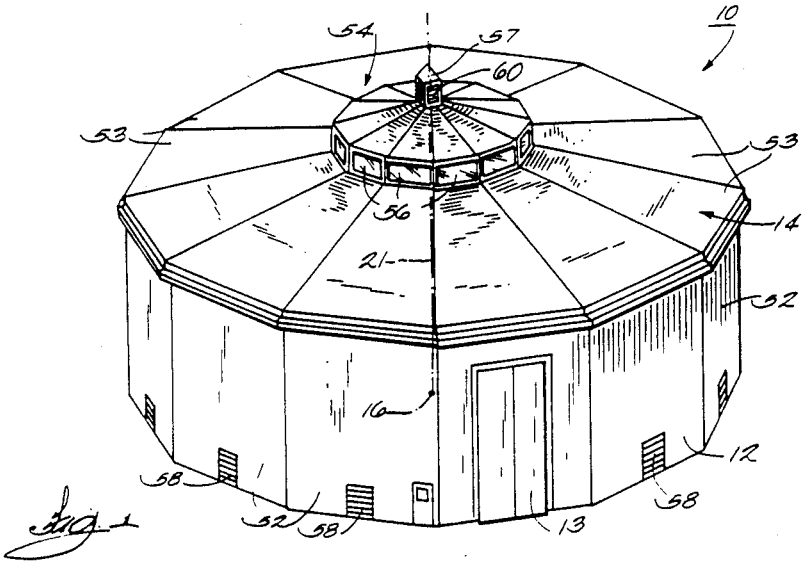
FIG. 1 is a perspective view of a dry boat storage building which embodies various of the features of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Figure 2:
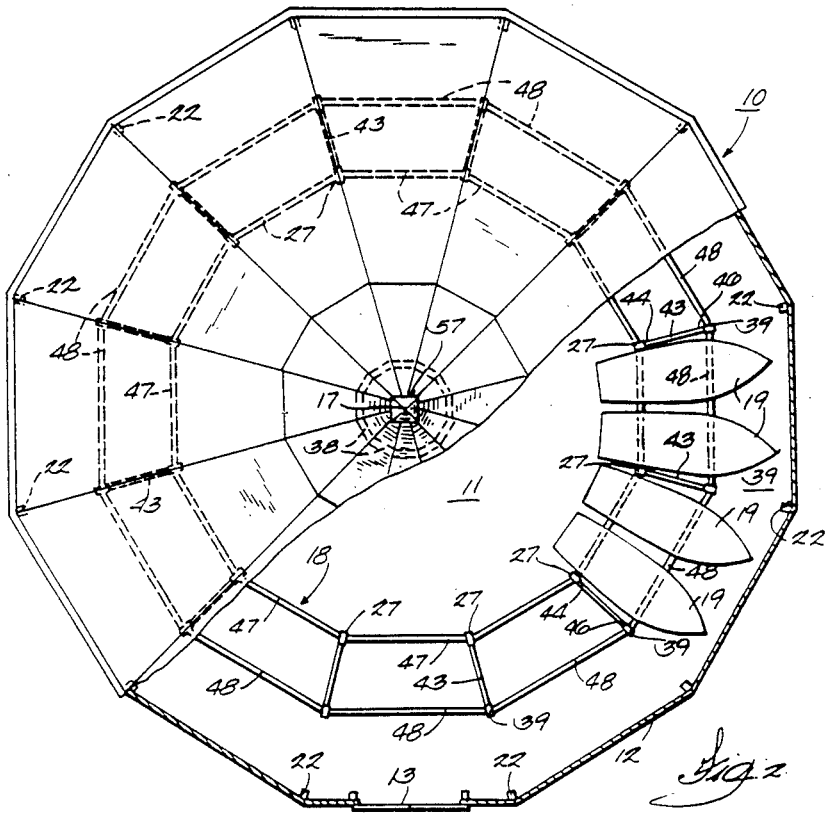
FIG. 2 is a top plan view, partially in section, of the dry boat storage building illustrated in FIG. 1.

A dry boat storage building 10 embodying the invention is illustrated in the drawings. As best shown in FIGS. 1, 2 and 3, the dry boat storage building 10 comprises a building of generally circular or polygonal shape, having a floor surface 11 and including a substantially vertical continuous outer wall 12 having therein formed a doorway 13 for providing access to the interior of the dry boat storage building 10. The dry boat storage building 10 further includes a roof 14 of substantially circular or polygonal shape disposed over the floor surface 11 and joining the continuous outer wall 12. The floor surface 11 has a center 16 (FIG. 3) and the continuous outer wall 12 is preferably disposed concentrically around the center 16. Similarly, the roof 14 includes a central point 17 which is positioned substantially directly vertically above the center 16.

Within the interior bounded by the continuous wall 12, the dry boat storage building 10 includes a substantially annular or cylindrical boat storage rack 18 of either circular or polygonal cross-section as shown in FIG. 2. The boat storage rack 18 is adapted to support a plurality of horizontally oriented boats 19 in vertically stacked, spaced relationship to one another and in a radial or fan pattern relative to a vertical central axis 21 extending between the central point 17 of the roof 14 and the center 16 of the floor surface 11. When so supported, the longitudinal axis of each of the boats 19 lies substantially along a radius extending through the vertical axis 21.

The construction of the dry boat storage building 10 is best illustrated in FIGS. 2 and 3. As shown, the building 10 includes a plurality of substantially vertical outer support columns 22 disposed circumferentially around the center 16 of the fixed floor surface 11. Each of the outer support columns includes an upper end 23, and a lower end 24 opposite the upper end and engaging the fixed floor surface 11. The outer support columns 22 are arranged such that adjacent columns are substantially parallel to one another. Preferably, the lower end 24 of each outer support column 22 rests on a concrete footing 26 set into the floor surface 11.

Within the area bounded by the outer support columns 22, the dry boat storage building further includes a plurality of substantially vertical inner support columns 27 each having an upper end 28 and a lower end 29. Like the outer support columns 22, the inner support columns 27 are also disposed circumferentially around the center 16 of the floor surface 11 and are arranged such that adjacent columns are substantially parallel to one another. Preferably, the lower end 29 of each inner support column 27 engages the floor surface 11 along a line extending radially outwardly from the floor center 16 to the lower end 24 of an adjacent outer support column 22. A concrete footing 31 is preferably provided for supporting the lower end 29 of each inner support column 27.

To provide support for the roof 14, the dry boat storage building 10 includes a plurality of beams or rafters 32 extending from the upper end 23 of each outer support column toward the central point 17 of the roof 14. Preferably, each of the rafters 32 includes an inner rafter 33, having an outer end 34 fixedly joined to the upper end 28 of an inner support column 27 and having an inner end 36 terminating at the central point 17 of the roof 14, and further includes an outer rafter 37 fixedly joined to the upper ends 28 and 23 of the inner and outer support columns 27 and 22. Preferably, each of the inner support columns 27 is of greater length than the outer support columns 22 such that each rafter 32 slopes downwardly from the central point 17 toward the upper ends 28 of the outer support column 22 and such that the roof 14 is pitched downwardly toward the outer wall 12.

To provide rigidity to the roof structure, connecting means are provided for joining the inner ends 36 of the inner rafters 33 to one another adjacent the central point 17. While various suitable connecting means can be employed, in the preferred embodiment, the connecting means includes a plurality of compression beams 38 disposed around the central point 17 and fixedly connected between adjacent ones of the inner rafters 33.

As further illustrated in FIGS. 2 and 3, the dry boat storage building 10 includes a plurality of intermediate vertical support columns 39 disposed circumferentially around the center 16 between each of the inner and outer vertical support columns 27 and 22. Each of the intermediate vertical support columns 39 includes an upper end 41 which terminates substantially short of the adjacent overhead outer rafter 37 and further includes a lower end 42 engaging the floor surface substantially along the radial line extending from the center 16 through the lower ends 24 and 29 of the adjacent outer and inner support columns 22 and 27. Preferably, a concrete footing 44 is provided for supporting the lower end 42 of each intermediate support column 39.

To form the boat storage rack 18, the dry boat storage building 10 includes a plurality of radially extending, substantially horizontal lateral support beams 43 each having an inner end 44 connected to one of the inner support columns 27 and an outer end 46 connected to an adjacent intermediate support column 39. A plurality of such lateral support beams interconnect each inner support column 27 with an adjacent intermediate support column 39, and the lateral support beams 43 are connected between the inner and intermediate support columns at fixed vertical intervals between the upper and lower ends 41 and 42 of the intermediate support columns 39. In the embodiment shown in FIG. 3, four such intermediate support columns 39 are connected between each intermediate and inner support column, thus forming four vertical levels at which boats can be stored in the boat storage rack 18.

The dry boat storage building 10, and in particular the boat storage rack 18, further includes a plurality of substantially horizontal inner transverse support beams 47, connected between adjacent ones of the inner support columns 27 at the vertical levels established by the horizontal lateral support beams 43, and includes a plurality of substantially horizontal outer transverse support beams 48 connected between adjacent ones of the intermediate support columns 39, also at the vertical levels established by the lateral support beams 43. Accordingly, the inner and intermediate support columns 27 and 39, in combination with the inner and outer transverse beams 47 and 48, and the lateral support beams 43, together define a substantially annular or cylindrical arrangement of individual boat storage cells 49 within the continuous outer wall 12 and around the center 16. As best shown in FIG. 4, four vertically stacked boat storage cells 49 are formed between each pair of adjacent inner support columns 27, and each boat storage cell is adapted to store two boats 19. To facilitate such storage, a Pair of cradles, each comprising an opposed pair of elongate, substantially parallel, padded support members 50 and 51, are mounted across the inner and outer transverse support beams 47 and 48 within each of the boat storage cells 49.

It will be appreciated that the intermediate support columns 39 not only serve to form part of the boat storage rack 18, but, together with the various transverse and lateral support beams 47, 48 and 43, also serve to rigidly support each of the inner vertical support columns 27 relative to the floor surface 11. Because the upper ends 28 of the inner support columns 27 are coupled through the inner and outer rafters 33 and 37 to the remainder of the building structure, such support serves to provide rigidity and strength to the entire structure. Accordingly, the boat storage rack 18 not only serves to provide support for boats during storage but also forms an integral structural assemblage which provides rigidity and strength to the entire boat storage building 10.

Preferably, the diameter of the boat storage rack 18 is sufficiently great so as to permit the individual boats to be easily withdrawn from the boat storage rack toward the center of the storage building and thereafter transported from the building through the doorway 13, but not so great as to unduly increase the size of the dry boat storage building and thereby waste storage space. To this end, the inner support columns 27 are preferably positioned so that the distance between each inner support column 27 and the vertical central axis 21 of the dry boat storage building 10 is no less than substantially 75%, nor more than substantially 200%, of the distance between the inner vertical support columns 27 and the outer vertical support columns 22. In the preferred embodiment illustrated, the radial distance between the central vertical axis 21 and the inner vertical support columns 27 is approximately 150% of the radial distance between the inner vertical support columns 27 and the outer vertical support columns 22.

The method utilized to transport the boats into the dry boat storage building is preferably selected in accordance with which of the individual boat storage cells 49 are to be filled. As illustrated in FIG. 2, the boat storage cells 49 formed by the annular boat storage rack 18 can be divided into two arc-shaped pluralities of individual storage cells. The first plurality of boat storage cells is centered about the doorway 13 and extends through substantially 90° of arc on either side of the doorway giving the first plurality of boat storage cells a total arc length of substantially 180°. The second plurality of boat storage cells comprises the remaining cells extending between the ends of the first plurality opposite the doorway 13 and also has a total arc length of substantially 180°. To load a boat into one of the boat storage cells in the first plurality (i.e. those nearest the doorway 13), the boat is first transported stern-first into the dry boat storage building 10 through the doorway 13 and is then moved bow-first toward, and into, the selected boat storage cell while rotating the boat right or left, as necessary, through an angle of no more than 120° and preferably less than 90°. To load a boat into one of the boat storage cells of the second plurality (i.e. those substantially opposite the doorway 13), the boat is transported bow-first through the doorway 13 and is then moved bow-first toward, and into, the selected boat storage cell while rotating the boat right or left, as necessary, through no more than 120° and preferably less than 90° of arc. It will be appreciated that the generally circular constructicn of the dry boat storage building 10 permits boats to be loaded into the boat storage cells without requiring rotation of the boat through more than 120° of arc, and usually through no more than 90° of arc. This, in turn, reduces the floor space required for maneuvering boats within the dry boat storage building 10 and, accordingly, increases the storage capacity of the facility.

As illustrated in FIG. 5, the distance between adjacent ones of the intermediate vertical support columns 39 is greater than the distance between adjacent ones of the inner vertical support columns 27. Accordingly, the shape of each boat storage cell 49 is particularly well suited for the storage of boats having maximum beam at a point between the bow and stern. As illustrated in FIG. 5, each of the boats 19 shown within the boat storage cell 49 has its maximum beam at a point spaced behind the bow approximately one-third the entire length of the boat 19. Because the boats 19 can be inserted into the boat storage cell 49 one at a time, the distance between adjacent ones of the inner vertical support columns 27 can be less than twice the maximum beam of each boat 19 and need only be somewhat greater than the transom-width of one boat combined with the maximum beam of the other. Thus, the shape of each boat storage cell 49 provides efficient use of the available storage area and further increases the boat storage capacity of the dry boat storage building 10 without increasing the physical size of the facility.

To form the continuous outer wall 12, a Plurality of substantially vertical wall panels 52 are mounted between adjacent ones of the outer support columns 22. Similarly, the roof 14 is formed of a plurality of roof panels 53 disposed over, and fixed to, adjacent ones of the inner and outer rafters 33 and 37. It will be appreciated that each of the wall panels 52 and roof panels 53 can, in turn, be formed of a plurality of sub-parts.

To provide the boat storage building 10 with adequate lighting and ventilation, the roof 14 is preferably provided with a raised cupola 54 at the central point 17. A plurality of substantially vertical windows 56 are provided in the sides of the cupola to permit sunlight to enter the interior of the dry boat storage building 10. Preferably, the cupola 54 includes an upwardly extending 4-sided central tower 57 having a plurality of louvers 60 therein formed for providing ventilation. Additional louvered panels 58 are provided in the outer wall 12 near ground level to further enhance building ventilation.

As shown in FIG. 3, the floor surface preferably includes a generally circular concrete slab 59 disposed within the area bounded by the lower ends of the inner vertical support columns 27 and over the center 16. Preferably, an annular gravel ring 61 is provided under the boat storage rack 18 in the area between the lower ends 29 and 24 of the inner and outer support columns 29 and 22.

Various other features and advantages of the invention are set forth in the following claims.

I claim:

1. A method of transporting boats into a dry boat storage building having a continuous outer wall, a doorway opening through the continuous outer wall, and a substantially annular boat storage rack within the boundary formed by the continuous outer wall and having a first plurality of boat storage cells arranged in a first arc centered about the doorway and extending through substantially 90° of arc on each side of the doorway and having a second plurality of boat storage cells arranged in a second arc opposite the doorway and extending through substantially 180° of arc between the ends of the first arc, said method comprising the step of inserting a boat bow-first into a selected one of the first plurality of boat storage cells by first transporting the boat stern-first into the building through the doorway and then inserting the boat bow-first toward and into the selected one of the boat storage cells of the first plurality while rotating the boat right or left through no more than 120° of arc, said method further comprising the step of inserting a boat bow-first into a selected one of the second plurality of boat storage cells by transporting the boat bow-first through the doorway and then inserting the boat bow-first into the selected boat storage cell of the second plurality while rotating the boat right or left through no more than 120° of arc after entering the dry boat storage building through the doorway.

2. A method in accordance with claim 1 wherein the boats are rotated less than 90° after entering the dry boat storage building through the doorway.

* * * * *